US005216782A

United States Patent [19]

Schenck et al.

[11] Patent Number: 5,216,782

[45] Date of Patent: Jun. 8, 1993

[54] SASH COUNTERBALANCE LEVELING DEVICE

[75] Inventors: Robert Schenck, Manitowoc; Jeffrey H. Hoffman, Two Rivers, both of Wis.; Joseph T. Scheurich, Beaumont, Tex.

[73] Assignee: Classic Modular Systems, Inc., Two Rivers, Wis.

[21] Appl. No.: 881,413

[22] Filed: May 11, 1992

Related U.S. Application Data

[63] Continuation-in-part of Ser. No. 666,343, Mar. 8, 1991, abandoned.

[51] Int. Cl.[5] ..... E05D 13/00; E05F 11/00; E05F 15/00

[52] U.S. Cl. ..... 16/194; 49/139; 49/360

[58] Field of Search ..... 16/194, 193; 49/445, 49/449, 139, 140, 360

[56] References Cited

U.S. PATENT DOCUMENTS 4,422,264 12/1983 Harris ..... 49/445

FOREIGN PATENT DOCUMENTS 187266 1/1964 Sweden ..... 49/445

*Primary Examiner*—John Sipos
*Assistant Examiner*—Carmine Cuda
*Attorney, Agent, or Firm*—Godfrey & Kahn

[57] ABSTRACT

A sash counterbalance device for a fume hood including a first cable having a first end and a second end, the first end being secured on the left side of a fume hood sash and wherein a first counterweight is secured on the second end of the first cable; a second cable having a first end and a second end, the first end of the second cable being secured on the right side of the sash, and wherein a second counterweight is secured on the second end of the second cable; and an axle which is mounted on the fume hood. The first and second cables are individually, separably, and concentrically wrapped about the axle such that movement of the sash causes a simultaneous movement of the axle by movement of the counterweights axle in a predetermined direction. The rotation of the axle synchronizes the movement of the first and second cables thereby causing the left and right sides of the sash to move vertically and in correspondingly equal amounts within a fume hood access opening thereby preventing the sash from becoming lodged within the access opening.

4 Claims, 4 Drawing Sheets

SASH COUNTERBALANCE LEVELING DEVICE

This application is a Continuation-In-Part of application Ser. No. 07/666,343; filed Mar. 8, 1991; now abandoned.

FIELD OF THE INVENTION

The present invention relates generally to a sash counterbalance, and more particularly to a sash counterbalance leveling device which is attached to a fume hood and which synchronizes the movement of fume hood sash lifting cables to prevent or substantially inhibit a fume hood sash from becoming lodged or otherwise impeded during its movement within an associated fume hood access opening.

BACKGROUND OF THE INVENTION

Fume hoods have long been used in research laboratories and the like to protect laboratory personnel from chemical and biological hazards which are attendant with the research environment. Although many different fume hood designs exist, a fume hood, generally speaking, includes a table-like structure having a flat working surface upon which is positioned a substantially rectangular shaped enclosure. This rectangular enclosure is defined by a roof member, a floor, a left wall, a right wall, a front wall, and a back wall. The front wall of the enclosure is defined, in part, by an access opening, or aperture, and a fume hood sash is movably borne by the fume hood and is operable for substantially vertical movement. This fume hood sash is often manufactured of a thick, heavy glass panel which may be located in a closed position, or alternatively may be selectively located to occlude the aperture thereby providing any desired amount of access to the protected working environment which is provided by that enclosure.

Fume hoods perform a number of laudatory functions, however their most important functional aspects are to provide a safe working surface to protect laboratory personnel and others, from the effects of harmful chemical splashes and spills or exposure to biological agents, and to evacuate noxious vapors and other gases or agents from the immediate working environment. Therefore, it is desirable that a fume hood have a means for selectively varying the size of its associated access opening or aperture to meet the demands of the laboratory environment. Heretofore, previous laboratory fume hoods have incorporated weighted counterbalance assemblies to provide a means for controlling the size of the access opening. Such counterbalance assemblies are operable to selectively retain the fume hood sash in any desired position and also to facilitate the raising and lowering of the fume hood sash, which is often quite heavy, within the supporting framework which defines the fume hood access opening.

A representative prior art, fume hood sash counterbalance assembly generally includes two separate and independently mounted sash counterbalance weights which are concealed within the opposite front corners of the enclosure and which are secured on the fume hood sash by two lifting cables. Although this particular sash counterbalance assembly design has operated with varying degrees of success, it is subject to shortcomings which have detracted from its usefulness. For example, in such a sash counterbalance assembly, the two separate counterbalance weights are impeded in their movement when they individually bump and scrape the inside surfaces of the enclosure structure when the fume hood sash is either raised or lowered. This bumping and scraping produces assorted annoying sounds, and creates friction between the counterbalance weights and the enclosure structure. This, of course, results in rough and jerky movement of the fume hood sash as it moves along its path of travel by virtue of the fume hood sash having to overcome the effects of this same friction to continue its vertical movement.

Further, this type of fume hood counterbalance assembly does not provide a means for preventing the fume hood sash from becoming cocked, lodged or otherwise misaligned within the access opening during the vertical movement of same. This latter shortcoming of known counterbalance assemblies is particularly troublesome and dangerous to personnel handling a hazardous substance while utilizing a fume hood during biological and chemical experimentation. In the past, and on those occasions when a fume hood sash became misaligned or lodged during use of the associated fume hood, laboratory personnel may have employed various expedient means to address this problem. For example, and if such an event was to occur and a laboratory worker was utilizing both hands to maneuver a hazardous substance, this same individual may have solicited assistance from surrounding personnel to dislodge the fume hood sash by applying physical force to same thereby avoiding an accidental spillage of the hazardous substance. This is, of course, undesirable inasmuch as it needlessly exposes other laboratory personnel to the hazardous environment of the fume hood.

Ideally, and to prevent a fume hood sash from becoming misaligned or lodged in a fume hood access opening, a fume hood sash should be raised and lowered in a substantially level position. This desired position may be achieved only if the left and right sides of the fume hood sash are raised or lowered in correspondingly equal amounts and at a substantially constant velocity. However, and in the prior art sash counterbalance assemblies, the two counterbalance weights have generally operated separately, and independently of each other, thereby permitting the left and right sides of the fume hood sash to travel in unequal amounts and at varying velocities. Such unequal movement by the left and right sides of the fume hood sash has often caused the sash to become cocked or lodged within the fume hood access opening, resulting in an unsafe operational condition in the immediate laboratory environment.

In recent years, other fume hood sash counterbalance assemblies have been designed to eliminate some of the existing shortcomings. For example, U.S. Pat. No. 3,934,496, to Turko, teaches the utilization of a single sash lifting cable and a single counterbalance weight to provide for smoother travel of the fume hood sash during vertical movement in the fume hood access opening. In this single weight counterbalance assembly, the ends of a single cable are connected to opposite sides of a fume hood sash and are routed over the top of the enclosure structure by pulleys. The middle of this single cable is then attached to a counterbalance weight which is located in the back of the enclosure. While this device may operate with some degree of success, that is, the counterbalance assembly may reduce the annoying sounds produced by other known counterbalance assemblies, such counterbalance assemblies do not provide a means for synchronizing the velocity of the opposite sides of a fume hood sash during vertical movement of the sash to prevent the sash from becoming misaligned during use of the fume hood by laboratory personnel.

Therefore, a need has existed for a sash counterbalance assembly which synchronizes the velocity of the opposite sides of a fume hood sash during any movement of the sash within a fume hood access opening thereby causing the sash to travel in a substantially constant level position to prevent the sash from becoming misaligned or lodged in the access opening thus increasing the hazards of the laboratory environment.

SUMMARY OF THE INVENTION

The present invention is directed to a new and novel sash counterbalance leveling device which substantially prevents a fume hood sash from becoming lodged or misaligned during its upward, and downward movement in a fume hood access opening, and which further selectively and smoothly varies the size of a fume hood access opening. While the two forms of the sash counterbalance leveling device of the present invention may be individually incorporated as a feature in new fume hood construction, they may also be configured so that they can be readily incorporated into existing fume hood structures, as in the nature of a retrofit, thereby replacing other less desirable types of sash counterbalance assemblies.

In accordance with the present invention, two forms of a sash counterbalance leveling device are provided which synchronize the movement of a pair of sash lifting cables, which have opposite first and second ends, through the use of a single axle. In this regard, the first end of a respective cable is individually connected on an opposite side of the fume hood sash, and is routed over the top of the fume hood by a respective pulley. The individual cables are then separately and individually wrapped a single turn about an axle and the opposite, second ends of the sash lifting cables are then individually and releasably secured to respective force means such as counterweights. In operation, the movement of the fume hood sash causes a substantially simultaneous movement of the first and second counterweights which correspondingly rotates the axle. In operation, the rotation of the axle, synchronizes the movement of the individual sash lifting cables. This action of the axle has the overall effect of causing the opposite sides of the fume hood sash to move smoothly, at a synchronized velocity and in correspondingly equal amounts. Therefore, and during any vertical movement of the fume hood sash within the access opening, the fume hood sash remains substantially level, which correspondingly inhibits the fume hood sash from becoming misaligned or lodged within the access opening.

It is therefore an object of the present invention to provide an improved fume hood sash counterbalance leveling device for preventing a fume hood sash from becoming misaligned, cocked or lodged in a fume hood access opening.

Another object of the present invention is to provide such a fume hood sash counterbalance leveling device which synchronizes the movement of individual fume hood sash lifting cables, thereby synchronizing the velocity of the opposite sides of a fume hood sash during its upward and downward movement within a fume hood access opening, and further causing the fume hood sash to be positioned in a substantially horizontal attitude throughout any vertical movement of the sash within the fume hood access opening.

Another object of the present invention is to provide such a fume hood sash counterbalance leveling device which is adapted to be incorporated into both new and existing fume hood construction.

Another object of the present invention is to provide a fume hood sash counterbalance leveling device which increases the safety of a laboratory working environment by substantially eliminating any hazards which may be caused by a fume hood sash becoming misaligned or lodged in an access opening during use of the fume hood.

Another object of the present invention is to provide a fume hood sash counterbalance leveling device which facilitates the raising and lowering of a heavy fume hood sash.

Another object of the present invention is to provide, in a second form of the sash counterbalance leveling device, a device which may be operated automatically by a drive means which is connected in force transmitting relation to the fume hood sash.

Another object of the present invention is to provide a fume hood sash counterbalance leveling device having a simple and durable construction and which is operable, virtually, to preclude damage thereto, or deterioration thereof, during use.

Another object of the present invention is to provide a fume hood sash counterbalance leveling device which is manufactured of inexpensive materials thereby facilitating the profitable construction thereof.

Another object of the present invention is to provide, in a first form of the sash counterbalance leveling device, a apparatus which is operated manually by laboratory personnel or the like.

Another object of the present invention is to provide a fume hood sash counterbalance leveling device which is characterized by ease of use, simplicity of construction, and which further may be manufactured at a relatively nominal cost.

Another object of the present invention is to provide a fume hood sash counterbalance leveling device which obtains the individual benefits to be derived from related devices and practices while avoiding the detriments individually associated therewith.

Another object of the present invention is to provide improved elements and arrangements thereof in a sash counterbalance leveling device for the purposes described, which are dependable, durable, and fully effective in accomplishing their intended purposes.

These and other objects and advantages are achieved in a sash counterbalance leveling device of the present invention and wherein the device includes a first cable having opposite first and a second ends, the first end being secured on a fume hood sash, and wherein a first counterweight is secured on the second end of the first cable; a second cable having opposite first and second ends, the first end of the second cable being secured on the fume hood sash, and wherein a second counterweight is secured on the second end of the second cable; and an axle mounted on the fume hood, the axle defining an axis of rotation, and wherein the first and second cables are individually and separately wrapped a single turn about the axle in a predetermined fashion such that movement of the fume hood sash causes a simultaneous rotation of the axle by means of the movement of the first and second counterweights, in the same direction, and wherein the rotation of the axle synchronizes the movement of the first and second cables thereby causing the left and right sides of the fume hood sash to move vertically and in correspondingly equal amounts thereby substantially preventing the sash member from becoming lodged within the fume hood access opening.

Further objects, features, and advantages of the invention will be apparent from the following detailed description taken in conjunction with the accompanying drawings.

DETAILED DESCRIPTION OF THE PREFERRED EMBODIMENT

First Form

Figure 1:
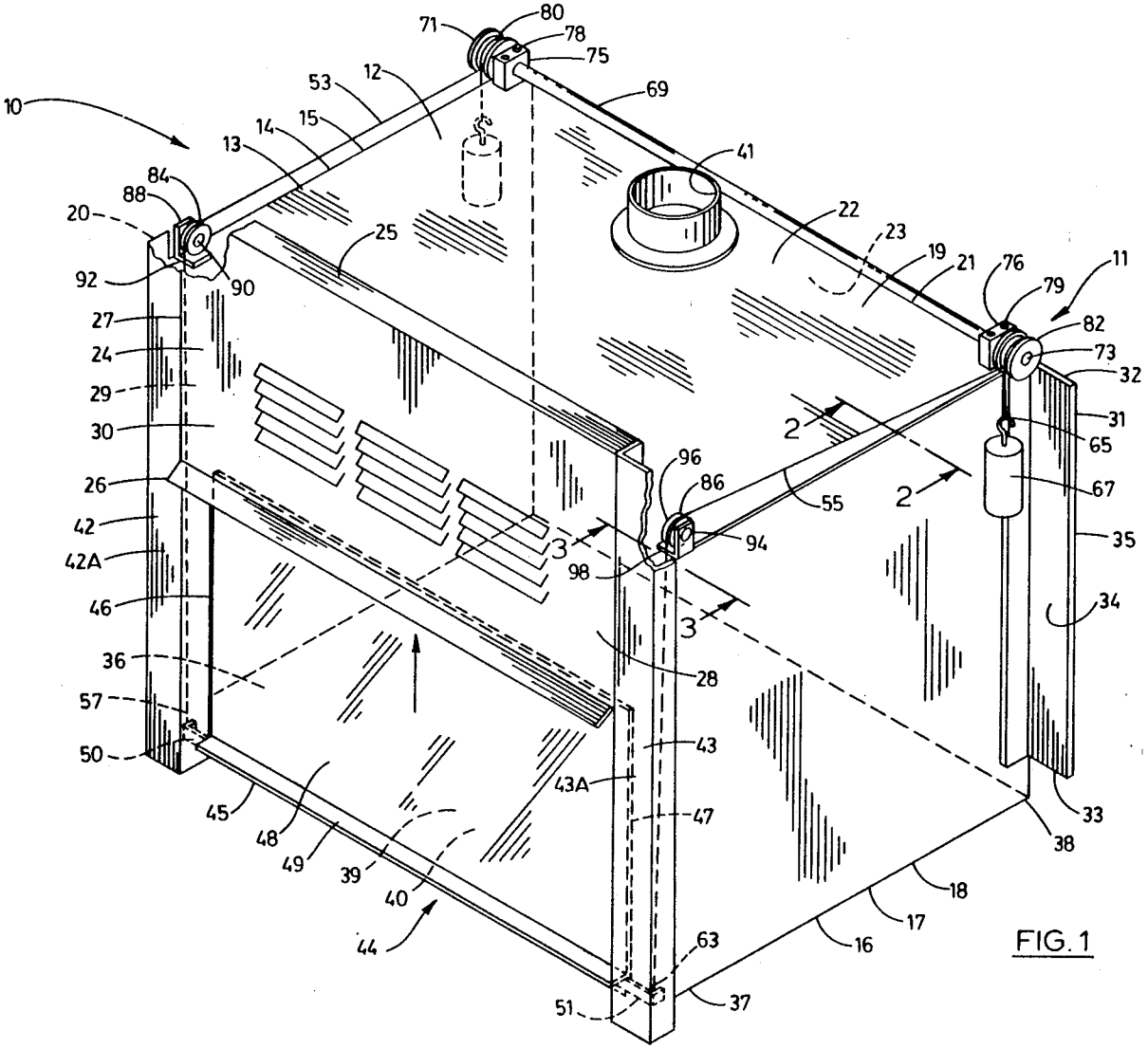
FIG. 1 is an environmental, perspective view of a first form of the present invention.

Referring to the drawings, and more particularly to FIG. 1, there is generally illustrated a conventional laboratory fume hood 10 upon which is mounted the sash counterbalance leveling device of the present invention and which is generally indicated by the numeral 11. The laboratory fume hood 10 includes a rectangular shaped housing or enclosure 12 which can be positioned upon a counter or a table structure (not shown). The rectangular shaped enclosure 12 includes a left wall 13 having an interior surface 14 and an exterior surface 15; a right wall 16 having an interior surface 17 and an exterior surface 18; a roof 19 having a front edge 20, a rear edge 21, a top exterior surface 22 and bottom interior surface 23; a front wall 24 having a top edge 25, a bottom edge 26, a left edge 27, a right edge 28, an interior surface 29 and an exterior surface 30; a back or rear wall 31 having a top edge 32, a bottom edge 33, an interior surface 34 and an exterior surface 35; a floor 36 having a front edge 37, a rear edge 38 and an interior surface 39. The interior surface 39 of the floor 36 functions as a flat working surface upon which chemical, biological or other experiments or procedures may be conducted. An interior working chamber 40 of the fume hood 10 is defined by the interior surfaces 14, 17, 23, 29, 34 and 39, respectively. The roof 19 has a large upright outlet duct 41 which is disposed adjacent to the top edge 32 of the rear wall 31, and through which noxious gases, vapors and other fumes from the interior working chamber 40 are evacuated. The front wall 24 continuously extends across the rectangular shaped enclosure 12. The left edge 27 of the front wall 24 is secured to a hollow left corner support post 42 having an exterior portion 42A and an interior portion not shown, and the right edge 28 of the front wall 24 is secured to a hollow right corner support post 43 having an exterior portion 43A and an interior portion not shown.

Immediately below the front wall 24 is an access opening or aperture 44, which is defined by the bottom edge 26 of the front wall 24, the left corner support post 42, the right corner support post 43, and the front edge 37 of the floor 36. There is provided in the access opening 44 a vertically movable fume hood sash 45 having a left side 46 and a right side 47. The fume hood sash 45 controls the size of the access opening or aperture 44 by being positioned in various locations in partially occluding relation relative to the access opening 44.

The fume hood sash 45 includes a transparent window panel 48 which can be formed of any clear synthetic material or safety glass. The window panel 48 is enclosed within a casing or frame 49 which includes a left sash support tab 50 and a right sash support tab 51. The casing 49 can be formed of any suitable material including synthetic, plastic, resins, or metal materials. In operation, the fume hood sash support tabs 50 and 51 slideably engage a channel (not shown) and which is formed in the left and right corner support posts 42 and 43, respectively, and the fume hood sash 45 is manually raised or lowered by laboratory personnel to selectively control the size of the access opening 44 to meet the particular demands of the individual chemical or biological experiments being conducted in the interior working chamber 40.

Again referring to FIG. 1, the sash counterbalance leveling device 11 of the present invention includes a first cable 53 and a second cable 55. The first cable 53 has a first end 57 and a second end 59. The first end 57 is secured on the left sash support tab 50 and the second end 59 is releasably secured on a first counterweight 61. The second cable 55 has a first end 63 and a second end 65. The first end 63 is secured on the right sash support tab 51 and the second end 65 is releasably secured to a second counterweight 67.

A freely rotatable axle 69, which defines an axis of rotation, and which includes a first end 71 and a second end 73, is mounted on the top exterior surface 22 of the roof 19 and is disposed proximate the rear edge 21. The first end 71 is received and rotatably mounted within a left axle bearing 75 and the second end 73 is received and rotatably mounted within a right axle bearing 76. The left and right axle bearings 75 and 76 are fastened on the top exterior surface 22 of the roof 19 by a pair of fasteners 78 and 79, respectively, which, in the preferred embodiment, includes a nut and bolt assembly. This is best seen by reference to FIG. 2. In the preferred embodiment, a first sheave 80 is fixed on the first end 71 of the axle 69, and a second sheave 82 is fixed on the second end 73. Further, a first pulley assembly 84 and a second pulley assembly 86 are rotatably mounted on the top exterior surface 22, and are individually positioned proximate the front edge 20 of the roof 19. More particularly, the first pulley assembly 84 is rotatably mounted in a position proximate the left corner support post 42. The first pulley assembly 84 includes a first pulley mounting bracket 88, a first pulley axle 90 and a first mounting bracket fastening means 92. The first pulley axle 90 defines a horizontal axis of rotation about which the first pulley assembly 84 is freely rotatable. The second pulley assembly 86 is similarly rotatably mounted in a position proximate the right corner support post 43. The second pulley assembly 86 includes a second pulley mounting bracket 94, a second pulley axle 96, and a second mounting bracket fastening means 98. The second pulley axle 96 defines a horizontal axis of rotation about which the second pulley assembly 86 is freely rotatable.

Figure 2:
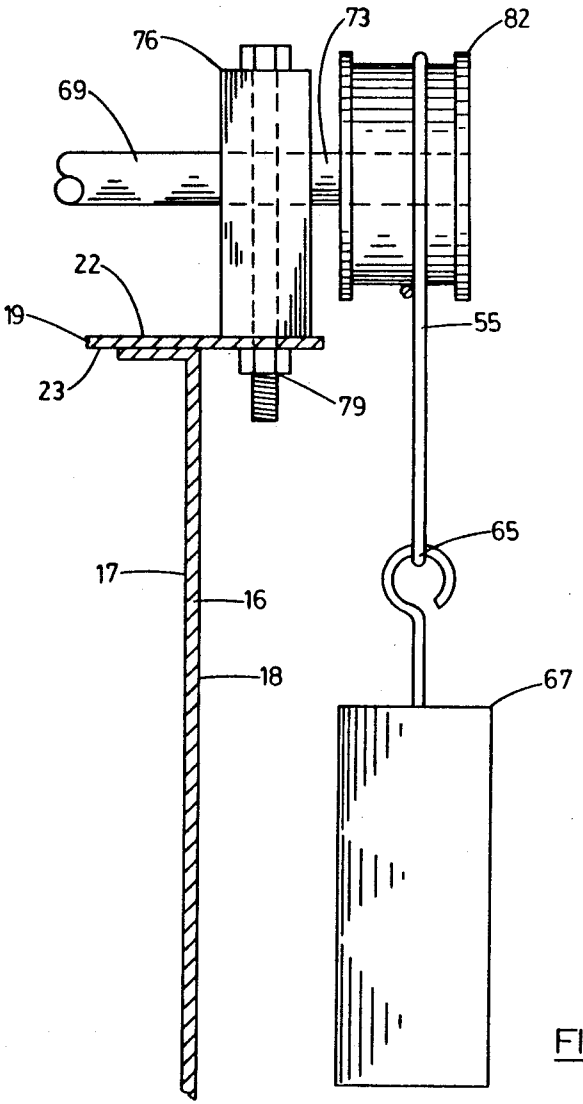
FIG. 2 is a fragmentary, enlarged, vertical, cross sectional view of the sash counterbalance leveling device of the present invention taken from a position along line 2—2 of FIG. 1.

FIG. 2 illustrates, in detail, the second end 73 of the axle 69. As should be understood, the first end 71 of the axle 69 is a mirror image of that shown in FIG. 2. Further, the operations of each end of the axle are identical, therefore, only one is described herein. As earlier discussed, the second end 73 is mounted for rotatable movement on the roof 19 by the right axle bearing 76. The right axle bearing 76 is fastened on the top exterior surface 22 of the roof 19 by the fastening means 79, which, in the preferred embodiment, is a nut and bolt assembly. The second sheave 82 is fixed on the second end 73 by welding or other suitable fastening techniques. The second cable 55 is preferably individually and separably wound about the second sheave 82 one turn. Although conceivably it is possible to have more than one turn in some applications, it should be noted that in the second form of the invention, which will be discussed hereinafter, more than one turn would probably have undesirable results in that a larger electric motor would be to be employed. As shown in FIG. 2, the cable 55 is wound in a counterclockwise direction when viewed endwardly of the sheave. The cable is then secured on the second counterweight 67. It is, of course, possible to wind the cable in a clockwise direction if that is desired. As should be understood, each of the cables are coated with a synthetic or man-made material to increase the friction between each of the cable surfaces, and the surfaces of the respective sheaves. This permits a single wrap of the cable to impart sufficient friction to the sheave to cause rotation of the axle 69 about the axis of rotation. The second end 65 of the second cable 55 is secured on the second counterweight 67 by a loop and hook arrangement or other similar means. As shown by the drawings, the second end 73 of the axle 69 extends beyond the right wall 16. During operation, and as the second cable 55 winds and unwinds about second sheave 82, the second counterweight 67 travels along a predetermined vertical path of travel without scraping and bumping the exterior surface 18 of the right wall 16.

Figure 3:
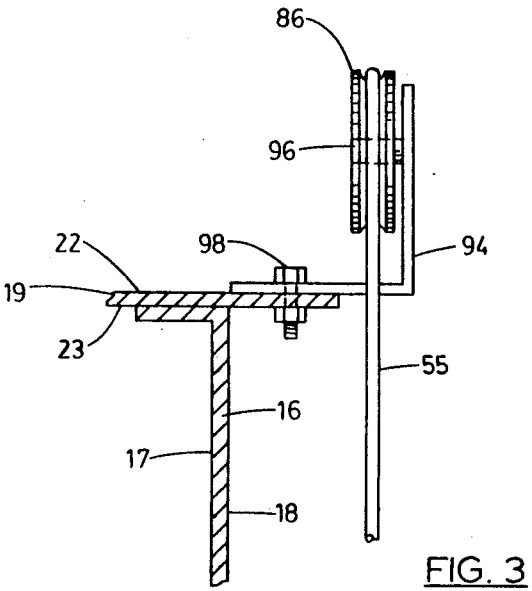
FIG. 3 is a fragmentary, enlarged, vertical, cross sectional, view of the sash counterbalance leveling device of the present invention taken from a position along line 3—3 of FIG. 1.

FIG. 3 illustrates, in detail, the second pulley assembly 86 of the sash counterbalance leveling device 11. As should be understood, the first pulley assembly 84 is a mirror image of the representation of FIG. 3. The second pulley mounting bracket 94 is fastened on the top exterior surface 22 of the roof 19 by the second mounting bracket fastening means 98. In the preferred embodiment, the second mounting bracket fastening means 98 is a nut and bolt assembly. Fixed on the second pulley mounting bracket 94 is the second pulley axle 96 which is freely rotatable and which defines a horizontal axis of rotation. The second cable 55 is individually and separably routed by the second pulley assembly 86 to the second sheave 82. The second pulley mounting bracket 94 is disposed in substantial alignment with the second sheave 82 to increase the mechanical efficiency of the sash counterbalance leveling device 11.

Second Form

The second form of the present invention is generally indicated by the numeral 100 and is best illustrated by reference to FIG. 4. The apparatus of the second form of the present invention contains all the assemblies and subassemblies which have been incorporated into the first form, and therefore, for purposes of brevity, these structures are not described in further detail herein. However, the second form of the present invention incorporates additional assemblies which are more particularly described in the paragraphs which follow.

Figure 4:
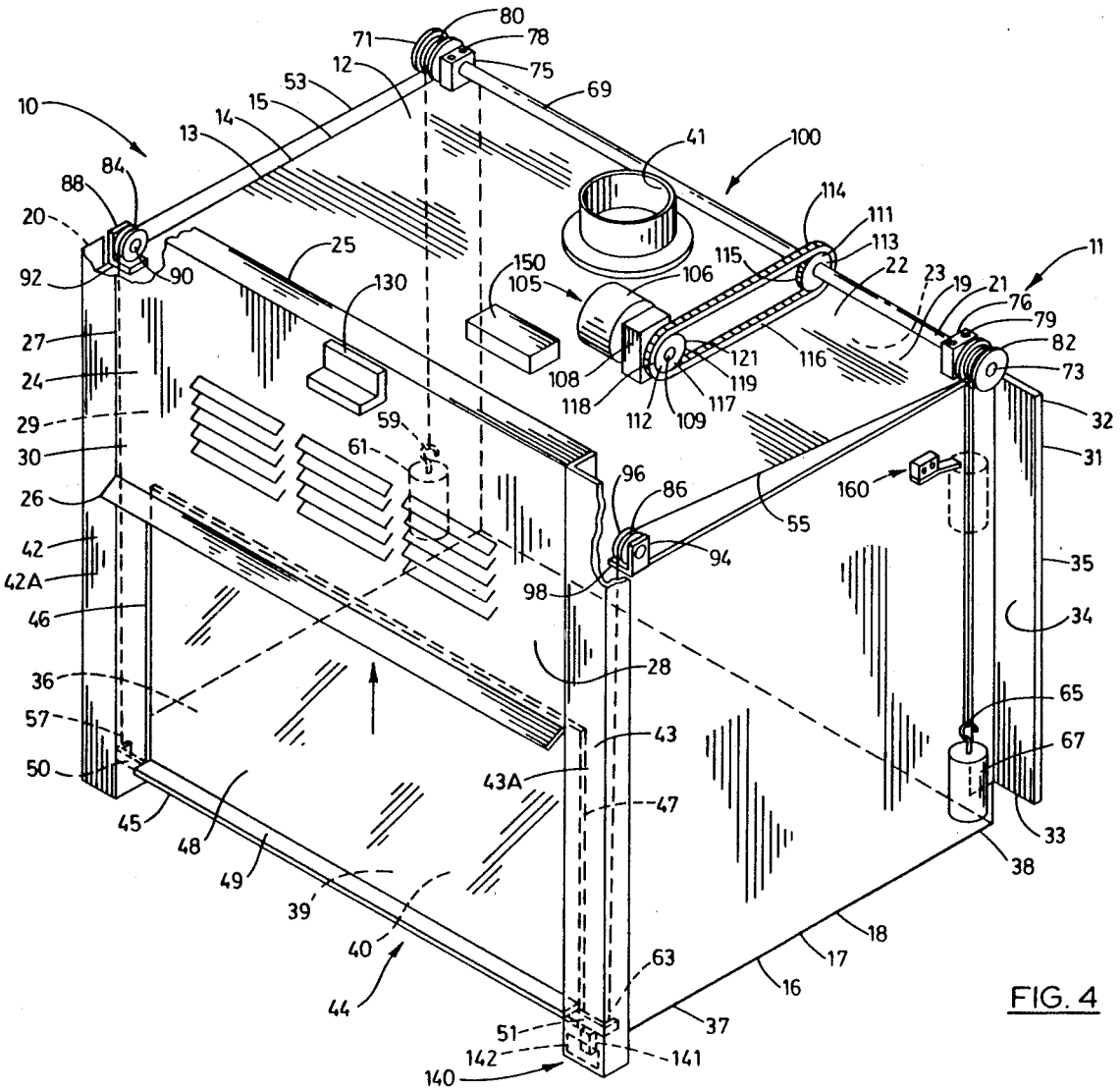
FIG. 4 is an environmental, perspective view of a second form of the present invention.

As illustrated in FIG. 4, a powered drive means which is generally indicated by the numeral 105 is mounted on the top exterior surface 22 of the roof 19. The powered drive means 105 includes a low RPM gear motor 106 having an output shaft, not shown, an electric clutch 108, a drive axle 109, and first and second sprockets 111 and 112, respectively. The electric clutch 108 is of conventional design and is widely known in the industry and is disposed in intermediate power transmitting relation relative to the output shaft, not shown, and the drive axle 109, respectively. The electric clutch is operable to permit the drive axle 109 to rotate freely on such occasions when the electric motor 106 is non-energized, such as during unintentional electrical component failure, or during electrical power outages or otherwise. Therefore, the electric clutch is operable to provide an additional safety feature of the apparatus 100 which is operable to permit the fume hood sash 45 to be raised or lowered manually. The first sprocket 111 is defined by right and left lateral surfaces 113 and 114, respectively, and is further defined by a peripheral edge 115 which has a plurality of teeth formed therein. The teeth are individually operable to matingly engage in power transmitting relation a suitable drive chain 116. The first sprocket 111 has a centrally disposed bore formed therein and which receives the axle 69. The first sprocket 111 is fixedly mounted on the axle 69 by welding or any other conventional fastening techniques such that movement of the first sprocket 111 causes a corresponding rotation of the axle 69 about the axis of rotation. Further, the sprocket 112 is defined by right and left lateral surfaces 117 and 118, respectively, and further includes a peripheral surface 119 which has a plurality of teeth 121 formed therein. The teeth are also individually operable to matingly engage in power transmitting relation the drive chain 116. The sprocket 112 has a centrally disposed bore formed therein which receives the drive axle 109 in such a fashion that rotation of the drive axle 109 causes a corresponding movement of the second sprocket 112. During operation, the powered drive means is controlled by an electronic circuit 125 which will be described in detail in the paragraphs which follow.

The apparatus 100 includes a motion detector 130 which is preferably a pulse count infrared detector. The motion detector is mounted for operation on the exterior surface 30 of the front wall 24. These motion detectors are widely known in the industry. A pulse count infrared detector which has proved to be particularly effective in the second form of the invention 100 is the Model RK 3000 Rokonet ® Mini Pulse Count Infrared Detector. Rokonet ® is a registered trademark of Rokonet Industries U.S.A. Inc., of 150 Clearbrook Road, Elmsford, N.Y. Operation of the motion detector 130 will be described in further detail in the paragraphs which follow.

A sash position sensing assembly generally indicated by the numeral 140 is operable to limit the downward movement of the fume hood sash 45. The sash positioning assembly 140 includes a magnetic assembly 141 and a magnetic pick-up or limit switch 142, both of which are shown in FIG. 4. As should be understood, the magnetic assembly 141 is fixedly mounted on the left or right sash support tabs, 50 or 51 respectively. The magnetic pick-up or limit switch 142 is fixedly mounted in a predetermined location on the interior portion of either the left or right corner support post, 42 or 43 respectively. It is anticipated, however, that the limit switch 142 may be movably mounted within the left or right corner support posts, or alternatively, a plurality of limit switches could be located along the length of the corner support posts. It should be understood, that the position sensing assembly 140 is operable to locate the fume hood sash 45 a predetermined distance above the floor 36. More particularly, and during operation of the second form of the present invention, movement of the sash 45 downwardly within the access opening positions the magnetic assembly 141 in activating relation relative to the limit switch 142. At a predetermined location wherein the magnetic assembly 141 is positioned in substantially juxtaposed relation relative to the limit switch 142, the limit switch in response causes the motor 106 to be deenergized thereby positioning the sash 45 in a predetermined position above the housing floor 36. Operation of the positioning assembly 140 will be described in further detail in the paragraphs hereinafter.

As best seen in FIG. 4, a power supply 150 is mounted on the top exterior surface 22 of the roof 19. The power supply 150 is a 12 volt power supply which is commonly utilized in the industry. Moreover, an emergency stop switch 160 is mounted on the exterior surface 18 of the right wall 16, and in a location substantially adjacent to the vertical path of travel of the second counterweight 67. As should be understood, the emergency stop switch 160 may be alternatively located in a similar position on the left wall 13 and relative to the first counterweight 61. The emergency stop switch 160 is operable to position the sash 45 in a predetermined position in the event of a failure of the electronic control circuit 125, electronic component failure, or failure of the position sensor 140. Upon occurrence of one of the aforementioned events, movement of the second counterweight 67 upward along the vertical path of travel will cause the second counterweight 67 to mechanically engage the emergency stop switch. When this event occurs, the emergency stop switch electrically deenergizes the motor 106. The emergency stop switch 160 will be described in further detail in the paragraphs to follow.

Figure 5:
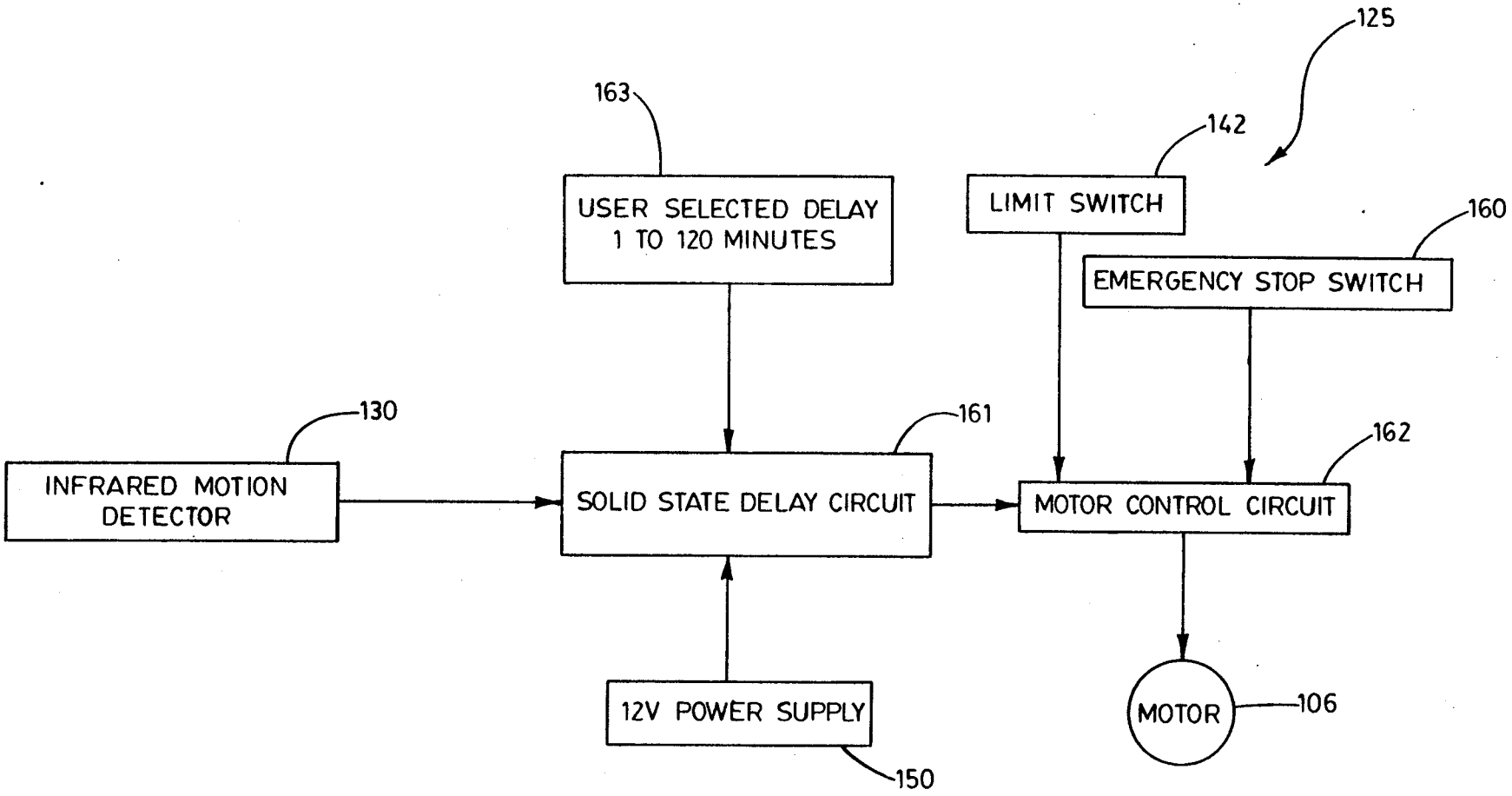
FIG. 5 is a schematic block diagram of an electronic control circuit which is employed in the second form of the present invention.

FIG. 5 illustrates, in schematic block diagram form, the electronic control circuit 125 which includes a solid state delay circuit 161; a motor control circuit 162; the low RPM gear motor 106; the motion detector 130; the limit switch 142; the power supply 150; and the emergency stop switch 160. The solid state delay circuit 161 and the motor control circuit 162 are well known in the industry, and therefore are not discussed in a greater detail herein. The power supply 150 is operable to selectively deliver a supply of electrical energy to electrically excite the electronic control circuit 125. More particularly, electrical power is supplied to the electronic control circuit 125 from the power supply 150 which is disposed in current flowing relation relative to the solid state delay circuit 161. From the solid state delay circuit 161, electrical current is supplied to the motor control circuit 162 which is disposed in electric current flowing relation relative to the solid state delay circuit 161. The motor control circuit 162 supplies the electric current to the gear motor 106. As should be understood, the motion detector 130 is disposed in signal transmitting relation relative to the solid state delay circuit 161. Moreover, and disposed in electrical transmitting relation relative to the solid state delay circuit is a user selected timing means 163, which is of conventional design, and which electrically actuates the solid state delay circuit 161. As should be understood, the user selected timing means 163 incorporates a means for selecting a predetermined length of time from 1-120 minutes such as, for example, a knob or such other assembly which may be mounted adjacent to the motion detector 130. During operation, a user selects a desired length of time from 1-120 minutes by selectively positioning the knob to a predetermined position thereby selectively actuating the timing means 163. If no motion is detected by the motion detector 130 in front of the fume hood, as would be the case when a laboratory worker was not present, upon termination of the selected time interval, the timing means 163 will electrically actuate the solid state delay circuit 161 which simultaneously permits electrical energy to flow to the motor control circuit 162 thereby energizing the motor 106. However, if motion is detected by the motion detector 130 during the selected interval of time, the solid state delay circuit 161 will deenergize the motor and will thereafter automatically reset the timing means 163 to the selected interval of time. This, of course, prevents injury to operators of the fume hood. As illustrated in FIG. 5, the limit switch 142 is disposed in the motor control circuit 162. When actuated by appropriately positioning the magnetic assembly adjacent to the limit switch 142, the limit switch 142 is operable to selectively deenergize the motor control circuit 162 thereby terminating the supply of electrical power to the motor 106. Therefore, during operation, the limit switch is operable to selectively position the sash 45 in a predetermined location above the housing floor 36. Moreover, the emergency stop switch 160 is also disposed in signal transmitting relation relative to the motor control circuit 162, and is operable to deenergize the motor control circuit 162 in the event of electronic component failure.

OPERATION

The operation of the described embodiments of the present invention are believed to be readily apparent and are therefore briefly summarized at this point.

In the manual operation of the sash counterbalance leveling device 11 of the present invention, the axle 69 is caused to rotate by the substantially simultaneous movement of the first and second counterweights 61 and 67, when the fume hood sash 45 is either raised or lowered. The rotation of the axle 69 synchronizes the movement of the first and second cables 53 and 55 which are concentrically wrapped in the same direction, a single turn, about the axle which thereby causes the left side 46 and the right side 47 of the fume hood sash 45 to move vertically and in correspondingly equal amounts. This has the further effect of causing the fume hood sash 45 to travel in a substantially level position thereby preventing or substantially inhibiting the fume hood sash 45 from becoming misaligned or lodged in undesired positions in the access opening 44. In this regard, if the sash is lifted at a point midway between the left side 46 and the right side 47, little torque is transmitted through the axle 69. However, if the sash 45 is lifted from either the left side 46 or the right side 47, the sash is prevented from becoming misaligned with respect to the access opening 44 by the torque which is transmitted by the axle 69 to the respective left and right axle ends 71 and 72. This arrangement permits the user of the fume hood to locate the sash in any desired position thereby selectively occluding the access opening 44, and thus accommodating any desired laboratory task or activity.

As best seen by reference to FIGS. 4 and 5, the second form of the present invention, is operable to automatically position the fume hood sash 45 in a predetermined position to selectively occlude the fume hood access opening 44. In the operation of the sash counter balance leveling device 100, of the second form, the axle 69 is driven by a low RPM gear motor 106 having an electric clutch 108 disposed intermediate the output shaft 107 and drive axle 109. Motor 106 is operable to drive the axle 69 at a constant velocity, and therefore, the first end 71 of axle 69 and the second end 73 are caused to rotate at the same velocity which synchronizes movement of the first and second cables 53 and 55 respectively. As described above, this has the effect of causing the fume hood sash 45 to travel in a substantially level position thereby preventing the fume hood sash 45 from becoming misaligned or lodged in undesired positions in the access opening 44.

Therefore, the two forms 11 and 100 of sash counterbalance leveling device of the subject invention are operable to synchronize the movement of the individual cables of a fume hood sash counterbalance assembly which, in turn, synchronizes the movement of the opposite sides of a fume hood sash during any vertical movement thereof within a fume hood access opening thereby preventing the sash from becoming misaligned or otherwise lodged within the access opening.

It is understood that the invention is not confined to the particular construction and arrangement of parts herein illustrated and described, but embraces such modified forms thereof as come within the scope of the following claims.

Having described our invention what we claim as new and desired to secure by Letters Patent is:

1. A sash counterbalance leveling device for a fume hood which includes a roof having opposite forwardly and rearwardly disposed peripheral edges, a floor, a left wall, a right wall, a front wall, and a back wall, the fume hood further defining an access opening, and wherein a sash member is slideably borne by the fume hood and operable for vertical movement to selectively occlude the access opening, the sash counterbalance leveling device comprising:

a first cable having opposite first and second ends, the first end secured on the sash member;

a first counterweight secured on the second end of the first cable;

a second cable having opposite first and second ends, the first end of the second cable secured on the sash member;

a second counterweight secured on the second end of the second cable;

an axle mounted on the roof of the enclosure and which defines an axis of rotation, the axle located near the rearward edge of the roof;

first and second pulleys mounted on the roof and located intermediate the axle and sash member, and near the forward edge of the roof, the first and second pulleys individually routing the first and second cables in the direction of the axle; and a power drive assembly mounted on the fume hood and operable to drive the axle in a predetermined direction, the power drive assembly including a low RPM gear motor having an output shaft, an electric clutch, and a drive axle, and wherein the electric clutch is disposed in intermediate power transmitting relation relative to the output shaft, and the drive axle respectively, the electric clutch permitting the drive axle to turn freely when the gear motor is not energized.

2. A sash counterbalance leveling device as claimed in claim 1, and wherein an electronic circuit selectively actuates the gear motor, the electronic control circuit including a motor control circuit, and a solid state delay circuit which has a motion detector electrically connected therewith, and wherein if no motion is detected by the motion detector for a predetermined period of time, the gear motor is activated which drives the sash in occluding relation relative to the opening, and wherein if motion is detected during motor operation, the motor is deenergized.

3. A sash counterbalance leveling device, as claimed in claim 2, and wherein the electronic control circuit includes an emergency stop switch which is operable to deenergize the motor upon the occurrence of an electronic component failure.

4. A sash counterbalance leveling device, as claimed in claim 3, and wherein the electronic control circuit includes a position sensor operable to deenergize the motor thereby positioning the sash in a predetermined location.

* * * * *